US012595922B2

(12) United States Patent
Kronström et al.

(10) Patent No.: US 12,595,922 B2
(45) Date of Patent: Apr. 7, 2026

(54) METHOD AND COMPUTER PROGRAM PRODUCT FOR EVACUATION OF CONTAMINATED AIR AND PREVENTION OF IGNITION IN AN AIR HANDLING SYSTEM

(71) Applicant: FLÄKTGROUP SWEDEN AB, Jönköping (SE)

(72) Inventors: Urban Kronström, Tranås (SE); Dusan Stamenkovic, Huskvarna (SE)

(73) Assignee: FLÄKTGROUP SWEDEN AB, Jönköping (SE)

( * ) Notice: Subject to any disclaimer, the term of this patent is extended or adjusted under 35 U.S.C. 154(b) by 463 days.

(21) Appl. No.: 18/004,942

(22) PCT Filed: Jul. 6, 2021

(86) PCT No.: PCT/SE2021/050686
§ 371 (c)(1),
(2) Date: Jan. 10, 2023

(87) PCT Pub. No.: WO2022/015220
PCT Pub. Date: Jan. 20, 2022

(65) Prior Publication Data

US 2023/0243533 A1 Aug. 3, 2023

(30) Foreign Application Priority Data

Jul. 13, 2020 (SE) ..... 2050887-5

(51) Int. Cl.
*F24F 11/36* (2018.01)
*F24F 11/89* (2018.01)
*F24F 110/65* (2018.01)

(52) U.S. Cl.
CPC ..... *F24F 11/36* (2018.01); *F24F 11/89* (2018.01); *F24F 2110/65* (2018.01)

(58) Field of Classification Search
CPC .. F24F 11/36; F24F 11/65; F24F 11/74; F24F 11/77; F24F 11/89; F24F 12/003;
(Continued)

(56) References Cited

U.S. PATENT DOCUMENTS

2014/0260692 A1 9/2014 Sharp
2018/0045424 A1* 2/2018 Yajima ..... F24F 7/007
(Continued)

FOREIGN PATENT DOCUMENTS

WO 2019245428 A1 12/2019

OTHER PUBLICATIONS

International Search Report and Written Opinion of the ISA/SE dated Jul. 15, 2021 in International Application No. PCT/SE2021/050686; 10pgs.

*Primary Examiner* — Tameem D Siddiquee
(74) *Attorney, Agent, or Firm* — Haukaas Fortius PLLC; Michael H. Haukaas; Paul K. Judd

(57) ABSTRACT

A safety system (1) for evacuation of contaminated air and prevention of ignition in an air handling system (2). The air handling system (2) comprises a supply air unit (3) arranged in a supply air duct (4), and an exhaust air unit (5) arranged in an exhaust air duct (6). The safety system (1) further comprises a supply air contamination sensor (7) arranged in the supply air duct (4), an exhaust air contamination sensor (8) arranged in the exhaust air duct (6). The supply air contamination sensor (7) and the exhaust air contamination sensor (8) collect air contamination data (9). The air handling system (2) further comprises a control unit (10) for comparison of collected air contamination data (9) to a predefined air contamination data threshold value (11), and for controlling the supply air unit (3), and the exhaust air unit (5).

2 Claims, 10 Drawing Sheets

(58) Field of Classification Search
CPC ..... F24F 2110/65; F24F 3/001; Y02B 30/52; Y02B 30/56; Y02B 30/70
See application file for complete search history.

(56) References Cited

U.S. PATENT DOCUMENTS

| | | | | |
|---|---|---|---|---|
| 2019/0170604 | A1 | 6/2019 | Kester | |
| 2019/0338981 | A1 | 11/2019 | Yajima et al. | |
| 2020/0049361 | A1 | 2/2020 | Minamida et al. | |
| 2020/0412107 | A1* | 12/2020 | Heimberg ..... | F25B 49/005 |

* cited by examiner

METHOD AND COMPUTER PROGRAM PRODUCT FOR EVACUATION OF CONTAMINATED AIR AND PREVENTION OF IGNITION IN AN AIR HANDLING SYSTEM

RELATED APPLICATIONS

This application is a National Stage filing under 35 U.S.C. § 371 of International Application No. PCT/SE2021/050686, filed Jul. 6, 2021, which claims priority to Swedish Patent Application No. 2050887-5 filed Jul. 13, 2020, which applications are incorporated herein by reference.

TECHNICAL FIELD

The present invention relates to a safety system, method and computer program product for evacuation of contaminated air and prevention of ignition in an air handling system.

BACKGROUND

Stricter environmental regulations regarding pollutants which have an effect on global warming will strongly impact the air handling systems of tomorrow. Taking into consideration the Global Warming Potential (GWP) of the refrigerant, where the refrigerant R410A often is used, is a very important area for improvement. One of the regulations of great importance, the EU regulation No 517/2014 of 16 Apr. 2014 on fluorinated greenhouse gases also known as the EU F-gas regulation, includes a phase down of refrigerants with high GWP values (CO2 equivalents). The objective of the F-gas regulation is to protect the environment by reducing emissions of fluorinated greenhouse gases. All coming generations of air handling systems with an integrated refrigerant system or for heating/cooling of air which is to be sold within the European Union must take into account the phase down schedule in 517/2014.

One solution of meeting the regulation is to use the R32 refrigerant instead of the R410A. This refrigerant is indeed suitable for cooling/heating applications comprising speed-controlled compressors. The GWP for R32 is 675, which is much less than the 2088 GWP for R410A. Further to this, the Coefficient of Performance (COP) of R32 is superior to many other refrigerants. The COP of R32 is for instance 5-10% higher than the COP of the R410A refrigerant. The R32 also provides the possibility to manufacture relatively compact refrigeration systems. It has a 5% higher volumetric cooling capacity compared to the R410A refrigerant.

R32 is a rather well-known refrigerant. As a component of R410A it is used in many residential refrigeration systems, but as a pure refrigerant it has not been used until recently. However, R32 is mildly flammable and forms poisonous hydrogen fluoride during combustion. R32 (Difluoromethane, HFC32, Methylene difluoride) is a single component refrigerant. In mixture with R125, the R32 refrigerant has been used to replace the ozone depleting R22 in various small air conditioning systems and heat pumps. The R125 has been used as a fire suspension agent in order to mitigate the flammability of R32. The 50/50% mixture of R32 with R125 is known as R410A and previously became a popular refrigerant.

According to EU regulations, R32 is classified as an extremely flammable gas, category 1 flammable, as it has greater than 12% flammability range by volume. However, contrary to this EU definition, R32 belongs to the mildly flammable A2L class by ASHRAE Standard 34 as it has low burning velocity.

If flammable refrigerant, such as for instance R32, would leak into the air handling system and in particular into the air flow stream inside the air handling system, there would be a risk that the refrigerant could ignite, due to various sources of ignition. Furthermore, when an air flow stream including leaked refrigerant exits the air handling system and enters the premises to be cooled/heated, there would be a risk that the refrigerant could ignite in proximity to human beings.

It is therefore desirable to accomplish an air handling system that reduces the risk of ignition of refrigerant and subsequently an explosion and/or a fire due to this.

SUMMARY OF INVENTION

An objective of the present invention is thus to accomplish a safety system that reduces or preferably eliminates the risk of high concentrations of leaking refrigerants in the air flow stream in an air handling system, and/or that reduces or preferably eliminates the risk of leaking refrigerant entering into the premises if such a leakage occurs. Furthermore, one objective of the present invention is to find a technical solution which reduces or preferably eliminates the risk of ignition, if a leakage of refrigerant has occurred.

According to one aspect, the invention concerns a safety system for evacuation of contaminated air and prevention of ignition in an air handling system. The air handling system comprises a compressor for compressing a refrigerant for further being led through an evaporator/condenser coil arranged in the air handling system, a supply air unit arranged in a supply air duct, and an exhaust air unit arranged in an exhaust air duct. The safety system comprises a supply air contamination sensor arranged in the supply air duct, an exhaust air contamination sensor arranged in the exhaust air duct. The supply air contamination sensor and the exhaust air contamination sensor collect air contamination data. The air handling system further comprises a control unit for comparison of collected air contamination data to a predefined air contamination data threshold value, and for controlling the supply air unit, and the exhaust air unit, and wherein the air handling system further comprises a power supply for providing power to the supply air unit, the exhaust air unit and the control unit.

An advantage of the solution, is that contaminated air could be evacuated from the supply air duct and/or the exhaust air duct. This reduces or preferably eliminates the risk of high concentrations of potentially leaking refrigerants in the air flow stream. This further results in that contaminated air does not ignite due to any electrical component present in the air handling unit, if a leakage of refrigerant has occurred. An advantage aim is thus to dilute potentially flammable gases. Another advantage is that a standard supply air unit and a standard exhaust air unit could be used in this cost-efficient safety system.

According to an embodiment of the invention, the safety system may comprise a supply air valve, variable between a closed and an open position, arranged in a supply air outlet end of the supply air duct for the supply of supply air to a room, an extract air valve, variable between a closed and an open position, arranged in an extract air inlet end of the exhaust air duct for the extraction of used extract air from the room into the exhaust air duct, and a by-pass valve, variable between a closed and an open position, arranged to connect the supply air duct and the exhaust air duct for the fluid connection of supply air in the event that the supply air valve and the extract air valve are closed. The supply air valve, the extract air valve and the by-pass valve may be controlled by the control unit.

An advantage of the solution, is that contaminated air could be evacuated from the supply air duct and/or the exhaust air duct. This reduces or preferably eliminates the risk of high concentrations of potentially leaking refrigerants in the air flow stream. This further results in that contaminated air does not ignite due to any electrical component present in the air handling unit, if a leakage of refrigerant has occurred. An advantage aim is thus to dilute potentially flammable gases.

Furthermore, contaminated air from the supply air duct and/or the exhaust air duct will be prevented from entering the premises, which reduces or eliminates the risk of ignition within the premises. One advantage is thus to dilute potentially flammable gases and for making sure that these gases do not enter premises where human beings are to be found.

Another advantage is that a standard supply air unit and a standard exhaust air unit could be used in this cost-efficient safety system.

According to an embodiment of the invention, the safety system may comprise an outdoor air valve, variable between a closed and an open position, arranged in an outdoor air inlet end of the supply air duct for the supply of supply air into the supply air duct, and an exhaust air valve, variable between a closed and an open position, arranged in an exhaust air outlet end of the exhaust air duct for the exhaust of used extract air from the exhaust air duct to the ambient. The outdoor air valve and the exhaust air valve may be controlled by the control unit.

An advantage of the solution, is that contaminated air could be evacuated from the supply air duct and/or the exhaust air duct. This reduces or preferably eliminates the risk of high concentrations of potentially leaking refrigerants in the air flow stream. This further results in that contaminated air does not ignite due to any electrical component present in the air handling unit, if a leakage of refrigerant has occurred. An advantage aim is thus to dilute potentially flammable gases.

This will be possible to achieve, even if an outdoor air valve and/or an exhaust air valve are arranged in the air handling unit. Furthermore, contaminated air from the supply air duct and/or the exhaust air duct will be prevented from entering the premises, which reduces or eliminates the risk of ignition within the premises. One advantage is thus to dilute potentially flammable gases and for making sure that these gases do not enter premises where human beings are to be found.

Another advantage is that a standard supply air unit and a standard exhaust air unit could be used in this cost-efficient safety system.

According to an embodiment of the invention, the outdoor air valve, the supply air valve, the extract air valve, the exhaust air valve, and the by-pass valve may be dampers.

An advantage of the solution, is that the safety system can be manufactured with standard components to a relatively reasonable cost.

According to an embodiment of the invention, the compressor may be arranged within the exhaust air duct.

An advantage of the solution, is that the compressor is physically close by the evaporator/condenser coil.

According to an embodiment of the invention, the compressor may be arranged within a compressor enclosure separate from the supply air duct and the exhaust air duct. The safety system comprises a compressor enclosure contamination sensor arranged in the compressor enclosure for collection of air contamination data, and a compressor enclosure duct unit connected to the compressor enclosure for evacuation of contaminated air from the compressor enclosure.

An advantage of the solution, is that contaminated air from the compressor enclosure could be evacuated if the refrigerant is leaking so that the contaminated air does not ignite due to any electrical component present in the compressor enclosure.

According to an embodiment of the invention, the compressor enclosure duct unit may further comprise a compressor enclosure extract air unit.

An advantage of the solution, is that, if the refrigerant is leaking, contaminated air from the compressor enclosure could be even more efficiently evacuated for instance directly to the ambient, so that the contaminated air does not enter the air treatment area of the air handling unit. Furthermore, contaminated air from the compressor enclosure could be even more efficiently evacuated if the refrigerant is leaking, so that the contaminated air does not ignite due to any electrical component present in the compressor enclosure.

According to an embodiment of the invention, a duct inlet of the compressor enclosure duct unit may be arranged in a bottom part of the compressor enclosure.

An advantage of the solution, is that contaminated air from the compressor enclosure could be even more efficiently evacuated if the refrigerant is leaking, so that the contaminated air does not enter the air treatment area of the air handling unit. Furthermore, contaminated air from the compressor enclosure could be even more efficiently evacuated if the refrigerant is leaking, so that the contaminated air does not ignite due to any electrical component present in the compressor enclosure.

According to an embodiment of the invention, an air supply inlet for supply of air may be arranged in a top part, in a middle part or in the bottom part of the compressor enclosure.

An advantage of the solution, is that contaminated air from the compressor enclosure could be even more efficiently evacuated if the refrigerant is leaking if the refrigerant is leaking, so that the contaminated air does not enter the air treatment area of the air handling unit. Furthermore, contaminated air from the compressor enclosure could be even more efficiently evacuated if the refrigerant is leaking, so that the contaminated air does not ignite due to any electrical component present in the compressor enclosure.

According to an embodiment of the invention, the predefined air contamination data threshold value may preferably be in the interval of 0.1-50% of a Lower Flammable Limit (LFL), may more preferably be in the interval of 5-25% of a Lower Flammable Limit (LFL), and may most preferably be in the interval of 15-20% of a Lower Flammable Limit (LFL).

An advantage of the solution, is that contaminated air could be evacuated from the supply air duct and/or the exhaust air duct at a very early stage, if the refrigerant is leaking, so that the contaminated air does not ignite due to any electrical component present in the air handling unit. Furthermore, according to some embodiments, contaminated air from the supply air duct and/or the exhaust air duct will be prevented from entering the premises at a very early stage, which reduces or eliminates the risk of ignition within the premises. In addition, according to some embodiments, is that contaminated air from the compressor enclosure could be evacuated at a very early stage if the refrigerant is leaking, so that the contaminated air does not enter the air treatment area of the air handling unit. Finally, according to some embodiments, contaminated air from the compressor enclosure could be evacuated at a very early stage if the refrigerant is leaking, so that the contaminated air does not ignite due to any electrical component present in the compressor enclosure.

According to an embodiment of the invention, the refrigerant may contain flammable gas.

An advantage of the solution, is that flammable gas could be evacuated from the supply air duct and/or the exhaust air duct if the refrigerant is leaking, so that the contaminated air does not ignite due to any electrical component present in the air handling unit. Furthermore, according to some embodiments, flammable gas from the supply air duct and/or the exhaust air duct will be prevented from entering the premises, which reduces or eliminates the risk of ignition within the premises. In addition, according to some embodiments, is that flammable gas from the compressor enclosure could be evacuated if the refrigerant is leaking, so that the contaminated air does not enter the air treatment area of the air handling unit. Finally, according to some embodiments, flammable gas from the compressor enclosure could be evacuated if the refrigerant is leaking, so that the contaminated air does not ignite due to any electrical component present in the compressor enclosure.

According to an embodiment of the invention, the flammable gas may be of the type R32 or any other A2L classified refrigerant.

An advantage of the solution, is that flammable gas of the type R32 or any other A2L classified refrigerant could be evacuated from the supply air duct and/or the exhaust air duct if the refrigerant is leaking, so that the contaminated air does not ignite due to any electrical component present in the air handling unit. Furthermore, according to some embodiments, flammable gas of the type R32 or any other A2L classified refrigerant from the supply air duct and/or the exhaust air duct will be prevented from entering the premises, which reduces or eliminates the risk of ignition within the premises. In addition, according to some embodiments, is that flammable gas of the type R32 or any other A2L classified refrigerant from the compressor enclosure could be evacuated if the refrigerant is leaking, so that the contaminated air does not enter the air treatment area of the air handling unit. Finally, according to some embodiments, flammable gas of the type R32 or any other A2L classified refrigerant from the compressor enclosure could be evacuated if the refrigerant is leaking, so that the contaminated air does not ignite due to any electrical component present in the compressor enclosure.

According to an embodiment of the invention, the flammable gas may be of the type propane or any other A3 classified refrigerant.

An advantage of the solution, is that flammable gas of the type propane or any other A3 classified refrigerant could be evacuated from the supply air duct and/or the exhaust air duct if the refrigerant is leaking, so that the contaminated air does not ignite due to any electrical component present in the air handling unit. Furthermore, according to some embodiments, flammable gas of the type propane or any other A3 classified refrigerant from the supply air duct and/or the exhaust air duct will be prevented from entering the premises, which reduces or eliminates the risk of ignition within the premises. In addition, according to some embodiments, is that flammable gas of the type propane or any other A3 classified refrigerant from the compressor enclosure could be evacuated if the refrigerant is leaking, so that the contaminated air does not enter the air treatment area of the air handling unit. Finally, according to some embodiments, flammable gas of the type propane or any other A3 classified refrigerant from the compressor enclosure could be evacuated if the refrigerant is leaking, so that the contaminated air does not ignite due to any electrical component present in the compressor enclosure.

According to a second aspect, the invention concerns a method for controlling a safety system for evacuation of contaminated air and prevention of ignition in an air handling system. The air handling system comprises a compressor for compressing a refrigerant for further being led through an evaporator/condenser coil arranged in the air handling system, a supply air unit arranged in a supply air duct, and an exhaust air unit arranged in an exhaust air duct. The safety system comprises a supply air contamination sensor arranged in the supply air duct, an exhaust air contamination sensor arranged in the exhaust air duct. The supply air contamination sensor and the exhaust air contamination sensor collect air contamination data. The air handling system further comprises a control unit for comparison of collected air contamination data to a predefined air contamination data threshold value, and for controlling the supply air unit, and the exhaust air unit. The air handling system further comprises a power supply for providing power to the supply air unit, the exhaust air unit and the control unit, wherein the method comprises the steps of: A. continuously retrieving air contamination data by means of the air contamination sensor, B. comparing the retrieved air contamination data to the predefined air contamination data threshold value by means of the control unit, when a value of a first contaminant in the retrieved air contamination data is higher than the predefined air contamination data threshold value, the control unit sends instructions to: C. start the supply air unit and the exhaust air unit, when said units are not operating, D. stop the compressor, when said compressor is operating, E. increase the speed of the supply air unit and the exhaust air unit to a predefined maximum speed, when said units are operating at a current speed lower than a predefined speed, and when a value of the first contaminant in the retrieved air contamination data is lower than the predefined air contamination data threshold value, the control unit sends instructions to: F. stop the supply air unit and the exhaust air unit after a predefined time.

An advantage of the solution, is that contaminated air could be evacuated from the supply air duct and/or the exhaust air duct if the refrigerant is leaking, so that the contaminated air does not ignite due to any electrical component present in the air handling unit. An advantage aim is thus to dilute potentially flammable gases.

According to a preferred embodiment, the safety system may further comprise a supply air valve, variable between a closed and an open position, arranged in a supply air outlet end of the supply air duct for the supply of supply air to a room, an extract air valve, variable between a closed and an open position, arranged in an extract air inlet end of the exhaust air duct for the extraction of used extract air from the room into the exhaust air duct, and a by-pass valve, variable between a closed and an open position, arranged to connect the supply air duct and the exhaust air duct for the fluid connection of supply air in the event that the supply air valve and the extract air valve are closed. The supply air valve, the extract air valve and the by-pass valve may be controlled by the control unit. The method may further comprise, before step D, the step of: opening the by-pass valve, closing the supply air valve, and closing the extract air valve.

An advantage of the solution, is that contaminated air could be evacuated from the supply air duct and/or the exhaust air duct if the refrigerant is leaking, so that the contaminated air does not ignite due to any electrical component present in the air handling unit. Furthermore, contaminated air from the supply air duct and/or the exhaust air duct will be prevented from entering the premises, which reduces or eliminates the risk of ignition within the premises. One advantage is thus to dilute potentially flammable gases and for making sure that these gases do not enter premises where human beings are to be found.

According to a preferred embodiment, the safety system may further comprise an outdoor air valve, variable between a closed and an open position, arranged in an outdoor air inlet end of the supply air duct for the supply of supply air into the supply air duct, an exhaust air valve, variable between a closed and an open position, arranged in an exhaust air outlet end of the exhaust air duct for the exhaust of used extract air from the exhaust air duct to the ambient. The outdoor air valve and the exhaust air valve may be controlled by the control unit. The method may further comprise, before step C, the steps of: A. opening the outdoor air valve, and B. opening the exhaust air valve.

An advantage of the solution, is that contaminated air could be evacuated from the supply air duct and/or the exhaust air duct if the refrigerant is leaking, so that the contaminated air does not ignite due to any electrical component present in the air handling unit. This will be possible to achieve, even if an outdoor air valve and/or an exhaust air valve are arranged in the air handling unit. Furthermore, contaminated air from the supply air duct and/or the exhaust air duct will be prevented from entering the premises, which reduces or eliminates the risk of ignition within the premises.

According to a third aspect of the invention a computer readable medium storing a computer program product is accomplished.

A computer program product is provided comprising coded instructions to implement a method when the computer program product is executed in a processor provided in the system.

A computer readable medium storing a computer program product is provided.

The technology described is in particular suitable for integrated cooling, heating and reversible heat pumps.

A3 and A2L are different safety group classifications of refrigerants according to the ANSI/ASHRAE Standard 34-2007. Designation and Safety Classification of Refrigerants.

Refrigerant is a term equivalent to the medium which circulates in a refrigerant circuit and which in heating mode picks up heat at a low temperature in the evaporator and subsequently releases the heat at a higher temperature and a higher pressure in the condenser. The refrigerant can take up and release more energy at the transition between different states (gas or liquid) than only a change in temperatures.

For heating mode the direct DX coil in the exhaust air is the equivalent as the evaporator in the heat pump circuit. The very same direct DX coil constitutes the condenser in cooling mode.

The evacuation unit may also be used as ventilation to avoid high temperatures in the compressor enclosure.

The Lower Flammable Limit (LFL) is the lower end of the concentration range of a flammable gas, which can ignite with air at normal temperature and pressure. Below LFL, the vapour/air mixture will not ignite. The LFL may be measured in kg/m3. The LFL for R32 equals 0.306 kg/m3.

One fan may be enough to ventilate the compressor enclosure to avoid flammable concentrations.

The collected air contamination data could instead be air quality data, where if the collected air quality data value is low enough this would imply that there is an air contamination present in the atmosphere and the system would thus react.

The compressor enclosure extract air unit could be arranged at an outlet of the compressor enclosure duct unit, in the duct unit, or at an inlet of the duct unit. If the compressor enclosure extract air unit comprises two fans, each specific fan could individually be arranged at an outlet of the duct unit, in the duct unit, or at an inlet of the duct unit.

The contaminated air is, in some embodiments, evacuated to outside the air handling unit and outside any premises so that human beings will not be affected by the contaminated air. In case of the contaminated air being a flammable refrigerant, the risk of ignition of the refrigerant is greatly reduced by evacuating the refrigerant to outside the air handling unit and outside any premises.

In the compressor enclosure there are often a lot of different electric and electronic components present. Power to these components may be shut down if there is contaminated air present.

An air flow sensor which may be arranged in the air handling system for collection of air flow data collects data with regards to the degree of air flow in the system. The sensor is arranged in such a manner that the air flow in, to, or from the air handling system can be measured.

At least one of the supply air unit, the exhaust air unit and the compressor enclosure extract air unit may be a fan.

Starting the supply air unit, the exhaust air unit and the compressor enclosure extract air unit at least at 5% of the nominal air flow of the system, which corresponds to an air flow velocity of 1.5-2.5 m/s in the system. In addition to this, the air flow of the system should be at least 0.1 m3/s.

If the collected air contamination data does stay over the predefined air contamination data threshold value, then the air flow of the system should be increased in steps of 0.1 m3/s until the maximum air flow of the system is reached. The time interval for each step should be between 1 second and 60 seconds.

The predefined time may preferably be 0.5-3 hours, more preferably 0.75-2 hours and most preferably 1-1.5 hours.

The wording ambient mentioned in the claims may be equivalent to the outdoors or the surrounding air external to the system, among others.

The outdoor air valve may function as an air valve for the supply of supply air into the supply air duct from the ambient, wherein the ambient may be the outdoors or be the ambient within an industrial premises.

Method according to claim 1, wherein the method further comprises after step B the step of triggering an alarm to be presented locally on e.g. the user interface of the control unit. Wherein the alarm may also be sent to a central control unit of the building. The central control unit of the building may sometimes be referred to as a Building Management System (BMS).

It may be an advantage to have a separate enclosure for the control unit of the system.

The contamination sensors of the system are continuously active in order to be able to react to any leakage at any given time, and are powered by means of the power supply.

BRIEF DESCRIPTION OF DRAWINGS

The invention is now described, by way of example, with reference to the accompanying drawings, in which.

DESCRIPTION OF EMBODIMENTS

In the following, a detailed description of a safety system for evacuation of contaminated air and prevention of ignition in an air handling system is provided.

Figure 1:
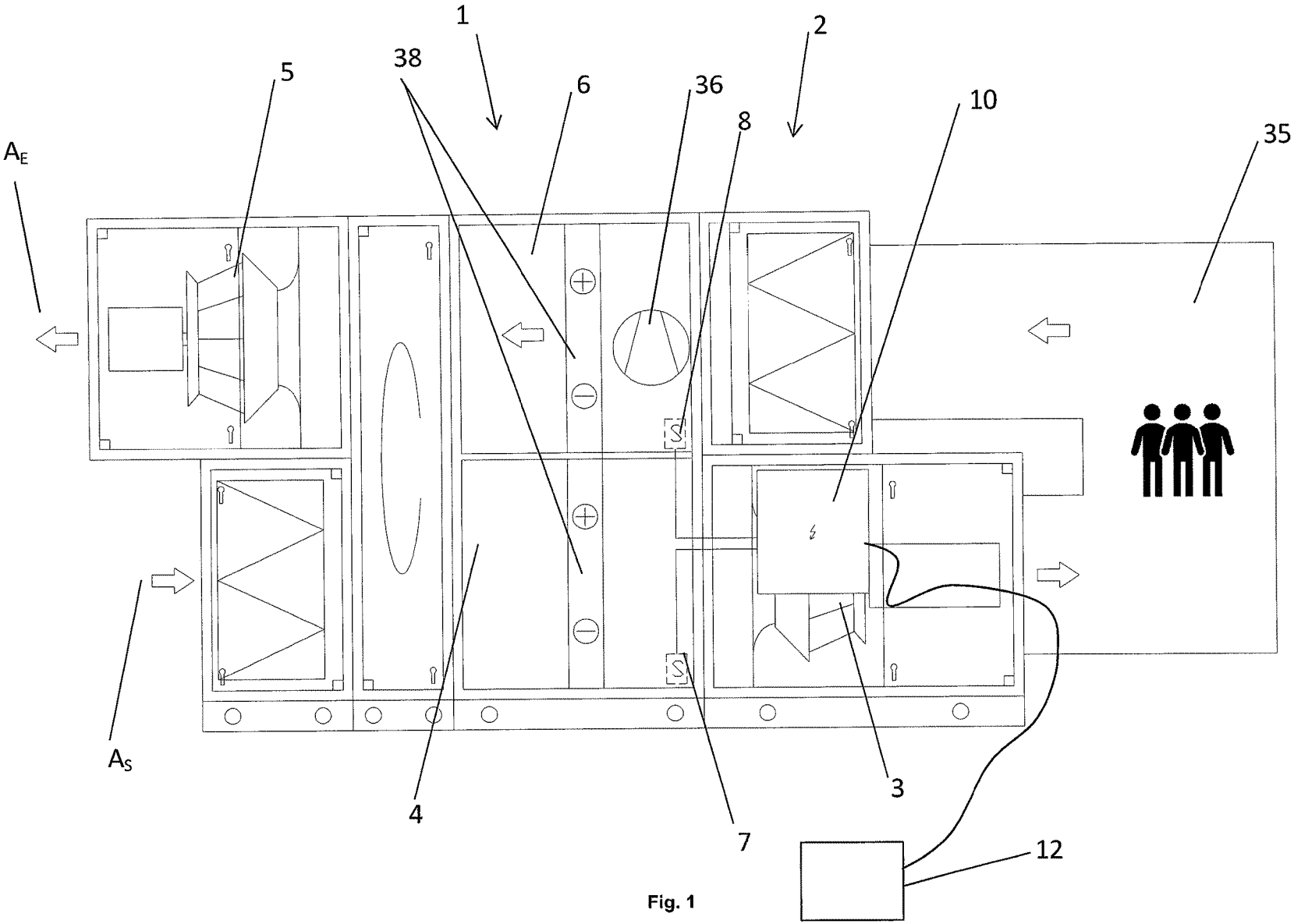
FIGS. 1, 3, 4, 5 and 6*a* show a safety system for evacuation of contaminated air and prevention of ignition in an air handling system, in a front view, according to an embodiment of the invention.

FIG. 1 shows a safety system 1 for evacuation of contaminated air and prevention of ignition in an air handling system 2, according to an embodiment of the invention. The air handling system 2 is made up of a compressor 36 for compressing a refrigerant 37 for further being led through an evaporator/condenser coil 38 arranged in the air handling system 2, a supply air unit 3 arranged in a supply air duct 4, and an exhaust air unit 5 arranged in an exhaust air duct 6. The safety system 1 is made up of a supply air contamination sensor 7 arranged in the supply air duct 4, an exhaust air contamination sensor 8 arranged in the exhaust air duct. The supply air contamination sensor 7 and the exhaust air contamination sensor 8 collect air contamination data. The air handling system 2 is further made up of a control unit 10 for comparison of collected air contamination data 9 to a predefined air contamination data threshold value 11, and for controlling the supply air unit 3, and the exhaust air unit 5. The air handling system 2 is further made up of a power supply 12 for providing power to the supply air unit 3, the exhaust air unit 5 and the control unit 10. The compressor 36 is arranged within the exhaust air duct 6.

Figure 2:
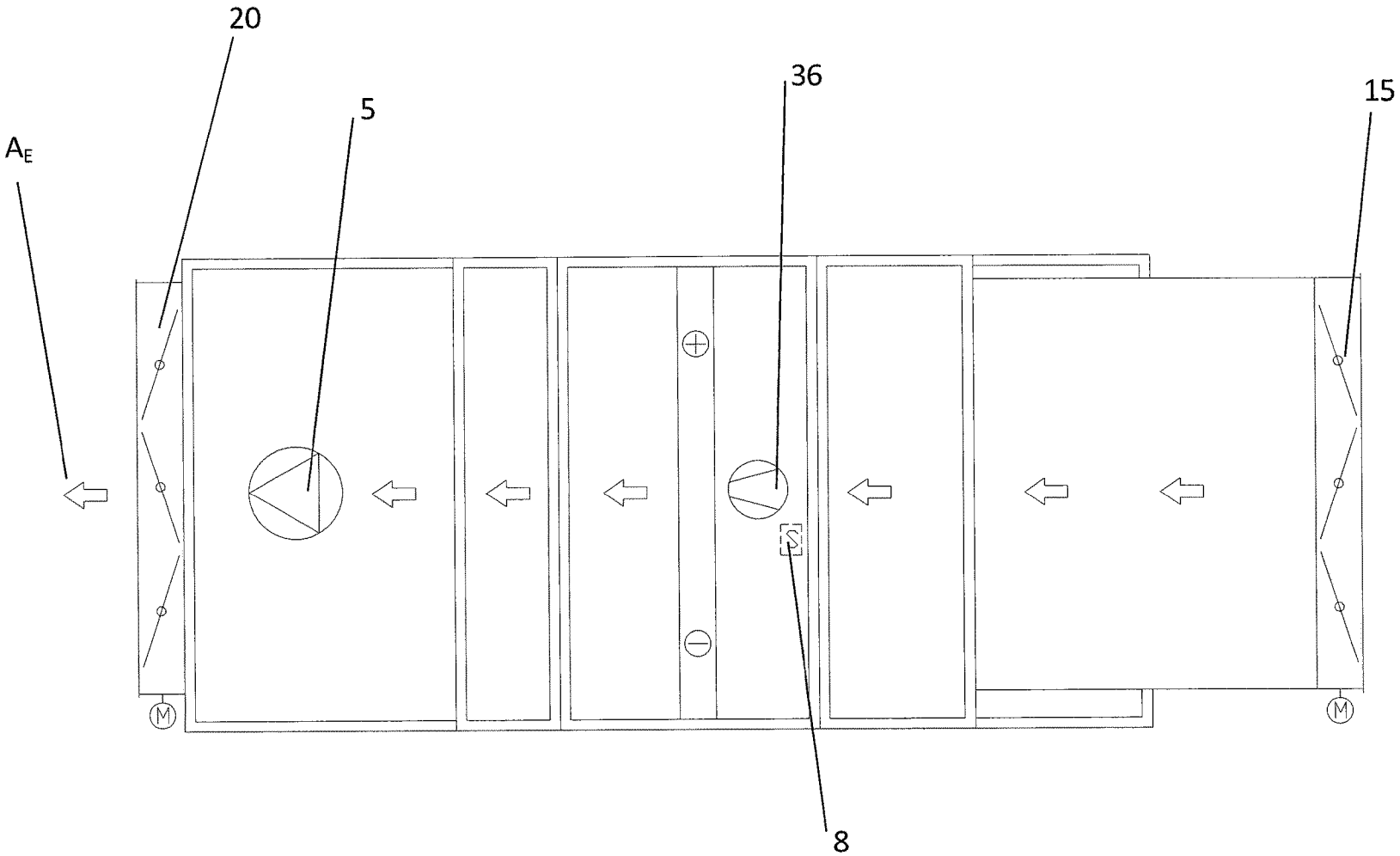
FIGS. 2, 6*b* and 6*c* shows a safety system for evacuation of contaminated air and prevention of ignition in an air handling system, from above, according to an embodiment of the invention.

FIG. 2 shows a safety system 1 for evacuation of contaminated air and prevention of ignition in an air handling system 2, according to an embodiment of the invention. The compressor 36 is arranged within the exhaust air duct 6. The system is further made up of an extract air valve 15, variable between a closed and an open position, arranged in an extract air inlet end 16 of the exhaust air duct 6 for the extraction of used extract air $A_E$ from the room 35 into the exhaust air duct 6. The system is further made up of an exhaust air valve 20, variable between a closed and an open position, arranged in an exhaust air outlet end 21 of the exhaust air duct 6 for the exhaust of used extract air $A_E$ from the exhaust air duct 6 to the ambient. The extract air valve 15 and the exhaust air valve 20 are controlled by the control unit 10.

Figure 3:
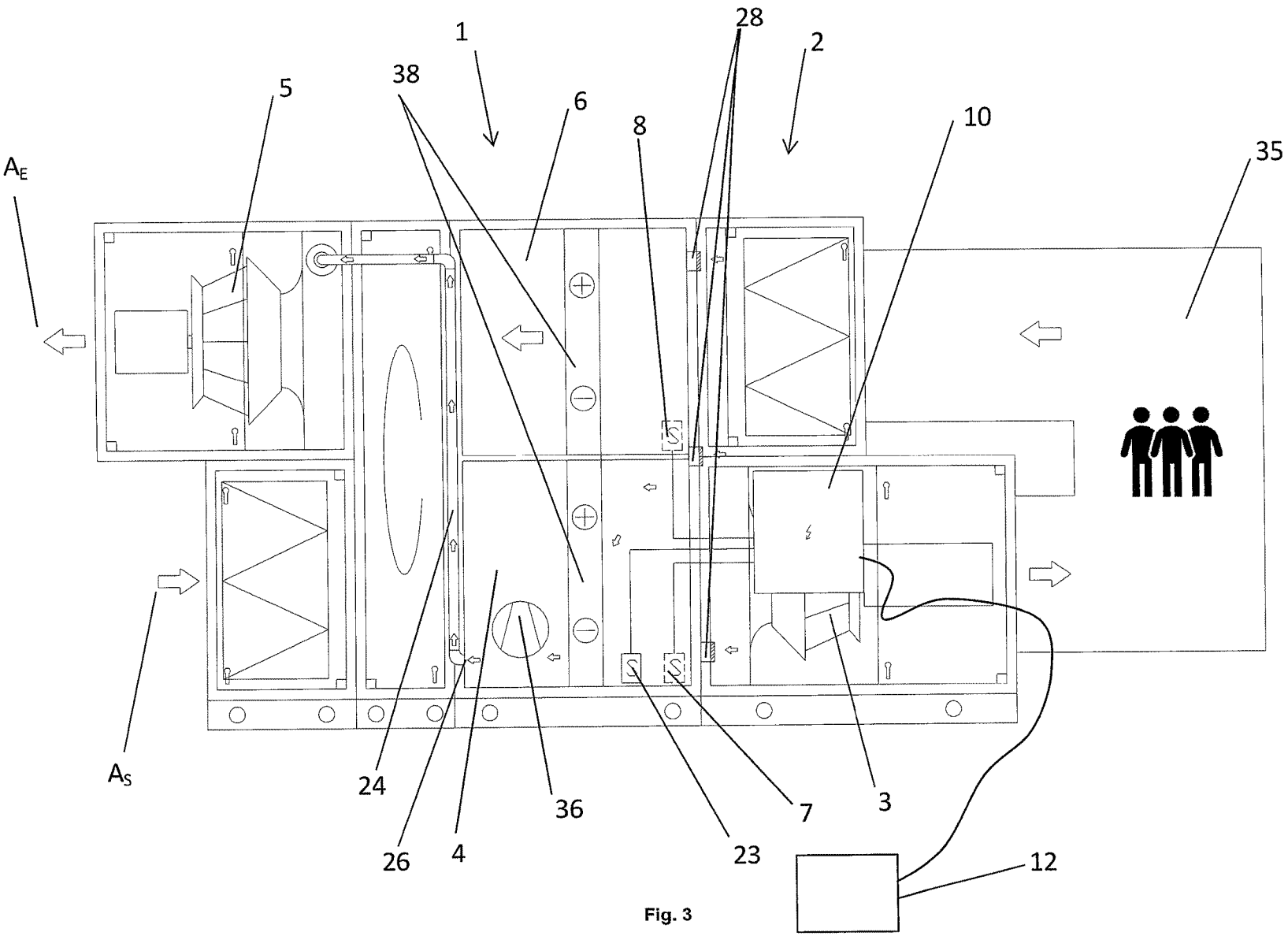

FIG. 3 shows a safety system 1 for evacuation of contaminated air and prevention of ignition in an air handling system 2, according to an embodiment of the invention. The air handling system 2 is made up of a compressor 36 for compressing a refrigerant 37 for further being led through an evaporator/condenser coil 38 arranged in the air handling system 2, a supply air unit 3 arranged in a supply air duct 4, and an exhaust air unit 5 arranged in an exhaust air duct 6. The safety system 1 is made up of a supply air contamination sensor 7 arranged in the supply air duct 4, an exhaust air contamination sensor 8 arranged in the exhaust air duct. The supply air contamination sensor 7 and the exhaust air contamination sensor 8 collect air contamination data. The air handling system 2 is further made up of a control unit 10 for comparison of collected air contamination data 9 to a predefined air contamination data threshold value 11, and for controlling the supply air unit 3, and the exhaust air unit 5. The air handling system 2 is further made up of a power supply 12 for providing power to the supply air unit 3, the exhaust air unit 5 and the control unit 10. The compressor 36 is arranged within a compressor enclosure 22 (not shown) separate from the supply air duct 4 and the exhaust air duct 6. A compressor enclosure contamination sensor 23 is arranged in the compressor enclosure 22 for collection of air contamination data 9.

Figure 4:
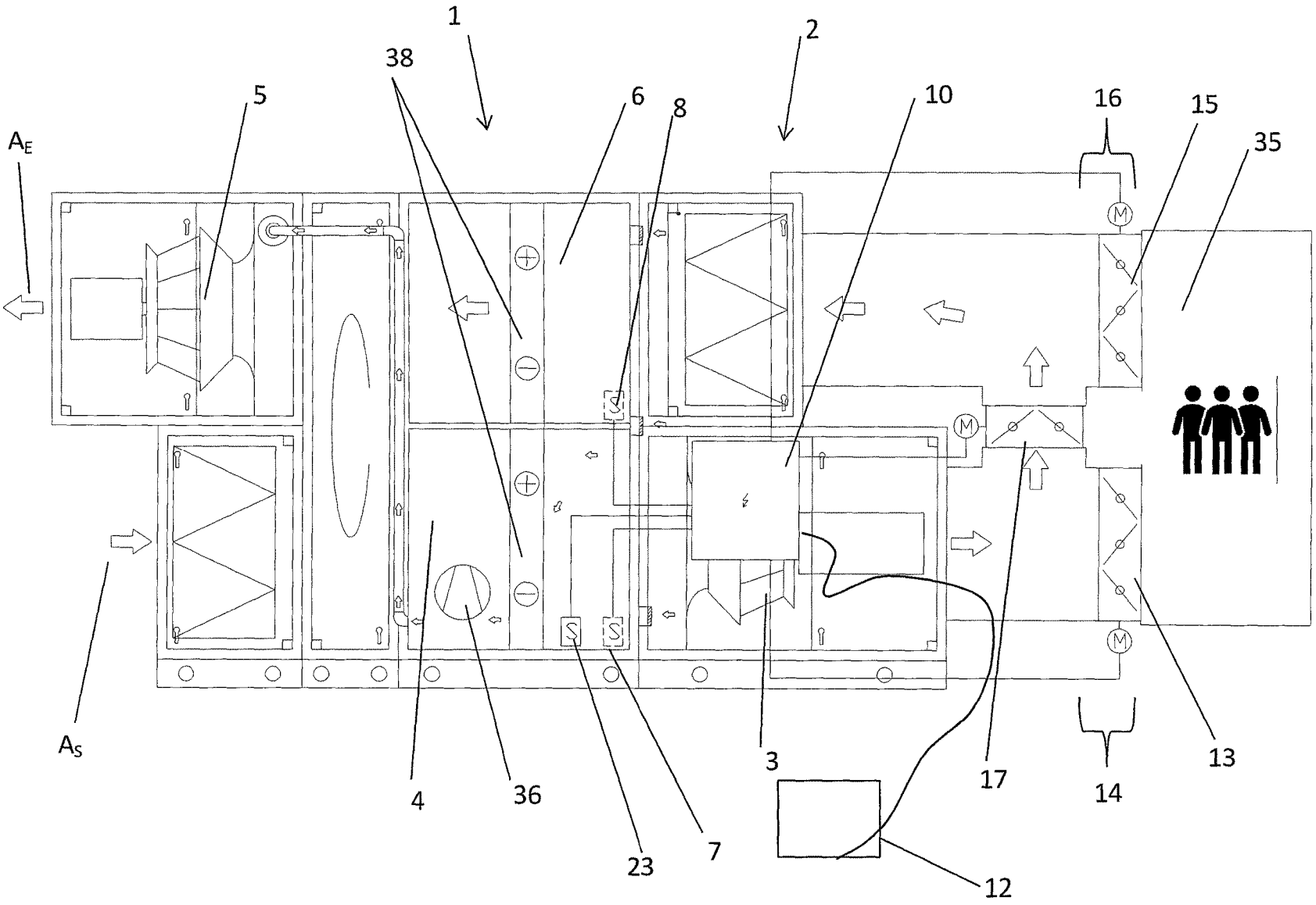

FIG. 4 shows a safety system 1 for evacuation of contaminated air and prevention of ignition in an air handling system 2, according to an embodiment of the invention.

The air handling system 2 is made up of a compressor 36 for compressing a refrigerant 37 for further being led through an evaporator/condenser coil 38 arranged in the air handling system 2, a supply air unit 3 arranged in a supply air duct 4, and an exhaust air unit 5 arranged in an exhaust air duct 6. The safety system 1 is made up of a supply air contamination sensor 7 arranged in the supply air duct 4, an exhaust air contamination sensor 8 arranged in the exhaust air duct. The supply air contamination sensor 7 and the exhaust air contamination sensor 8 collect air contamination data. The air handling system 2 is further made up of a control unit 10 for comparison of collected air contamination data 9 to a predefined air contamination data threshold value 11, and for controlling the supply air unit 3, and the exhaust air unit 5. The air handling system 2 is further made up of a power supply 12 for providing power to the supply air unit 3, the exhaust air unit 5 and the control unit 10. The safety system 1 is further made up of a supply air valve 13, variable between a closed and an open position, arranged in a supply air outlet end 14 of the supply air duct 4 for the supply of supply air $A_S$ to a room 35, an extract air valve 15, variable between a closed and an open position, arranged in an extract air inlet end 16 of the exhaust air duct 6 for the extraction of used extract air $A_E$ from the room 35 into the exhaust air duct 6, and a by-pass valve 17, variable between a closed and an open position, arranged to connect the supply air duct 4 and the exhaust air duct 6 for the fluid connection of supply air $A_S$ in the event that the supply air valve 13 and the extract air valve 15 are closed. The supply air valve 13, the extract air valve 15 and the by-pass valve 17 are controlled by the control unit 10. The compressor 36 is arranged within a compressor enclosure 22 (not shown) separate from the supply air duct 4 and the exhaust air duct 6. A compressor enclosure contamination sensor 23 is arranged in the compressor enclosure 22 for collection of air contamination data 9.

Figure 5:
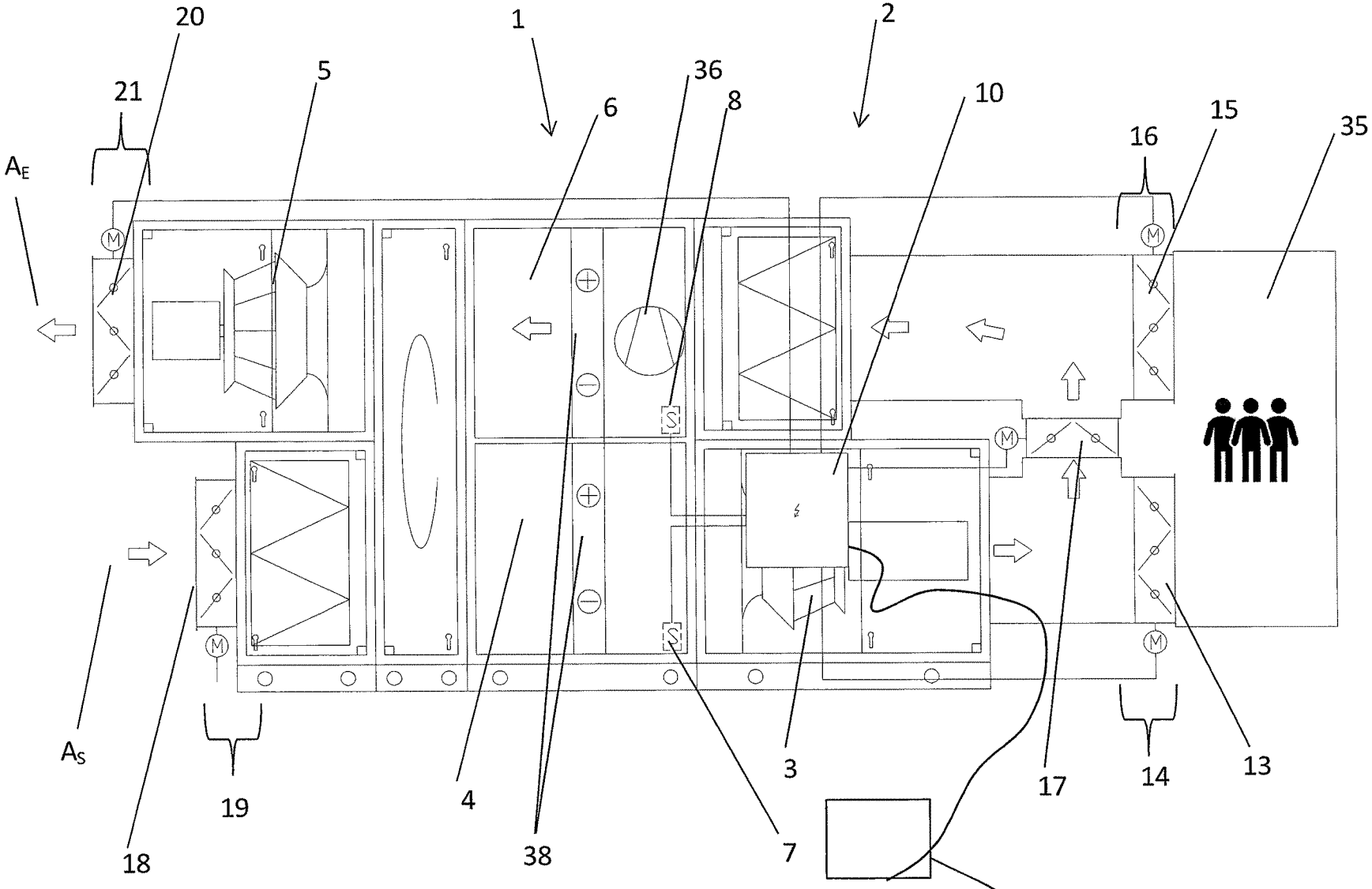

FIG. 5 shows a safety system 1 for evacuation of contaminated air and prevention of ignition in an air handling system 2, according to an embodiment of the invention. The air handling system 2 is made up of a compressor 36 for compressing a refrigerant 37 for further being led through an evaporator/condenser coil 38 arranged in the air handling system 2, a supply air unit 3 arranged in a supply air duct 4, and an exhaust air unit 5 arranged in an exhaust air duct 6. The safety system 1 is made up of a supply air contamination sensor 7 arranged in the supply air duct 4, an exhaust air contamination sensor 8 arranged in the exhaust air duct. The supply air contamination sensor 7 and the exhaust air contamination sensor 8 collect air contamination data. The air handling system 2 is further made up of a control unit 10 for comparison of collected air contamination data 9 to a predefined air contamination data threshold value 11, and for controlling the supply air unit 3, and the exhaust air unit 5. The air handling system 2 is further made up of a power supply 12 for providing power to the supply air unit 3, the exhaust air unit 5 and the control unit 10. The safety system 1 is further made up of a supply air valve 13, variable between a closed and an open position, arranged in a supply air outlet end 14 of the supply air duct 4 for the supply of supply air $A_S$ to a room 35, an extract air valve 15, variable between a closed and an open position, arranged in an extract air inlet end 16 of the exhaust air duct 6 for the extraction of used extract air $A_E$ from the room 35 into the exhaust air duct 6, and a by-pass valve 17, variable between a closed and an open position, arranged to connect the supply air duct 4 and the exhaust air duct 6 for the fluid connection of supply air $A_S$ in the event that the supply air valve 13 and the extract air valve 15 are closed. The supply air valve 13, the extract air valve 15 and the by-pass valve 17 are controlled by the control unit 10. The safety system 1 is further made up of an outdoor air valve 18, variable between a closed and an open position, arranged in an outdoor air inlet end 19 of the supply air duct 4 for the supply of supply air $A_S$ into the supply air duct 4, and an exhaust air valve 20, variable between a closed and an open position, arranged in an exhaust air outlet end 21 of the exhaust air duct 6 for the exhaust of used extract air $A_E$ from the exhaust air duct 6 to the ambient. The outdoor air valve 18 and the exhaust air valve 20 are controlled by the control unit 10. The compressor 36 is arranged within the exhaust air duct 6.

Figures 6A, 6B, 6C:
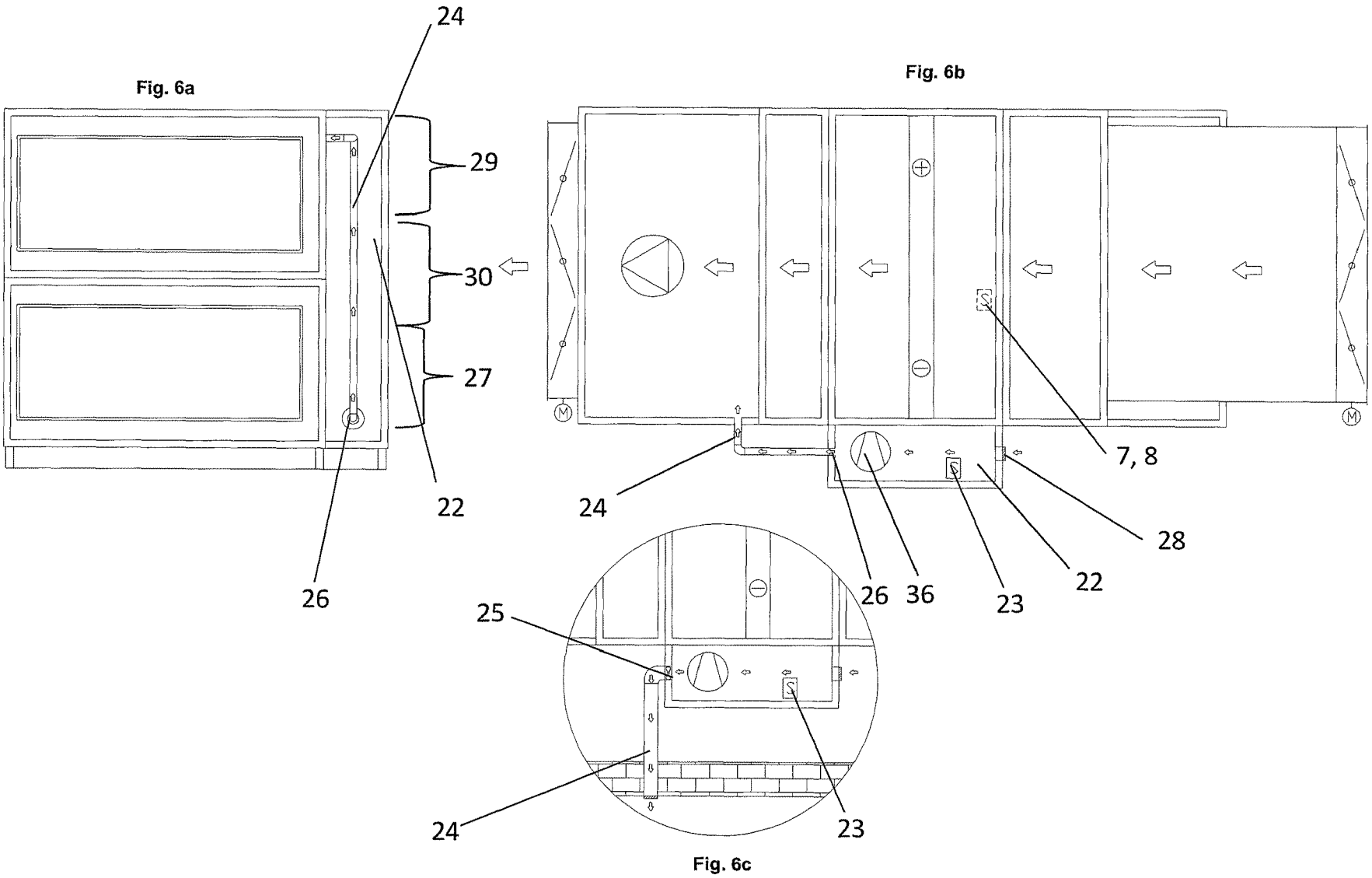
Figure 7:
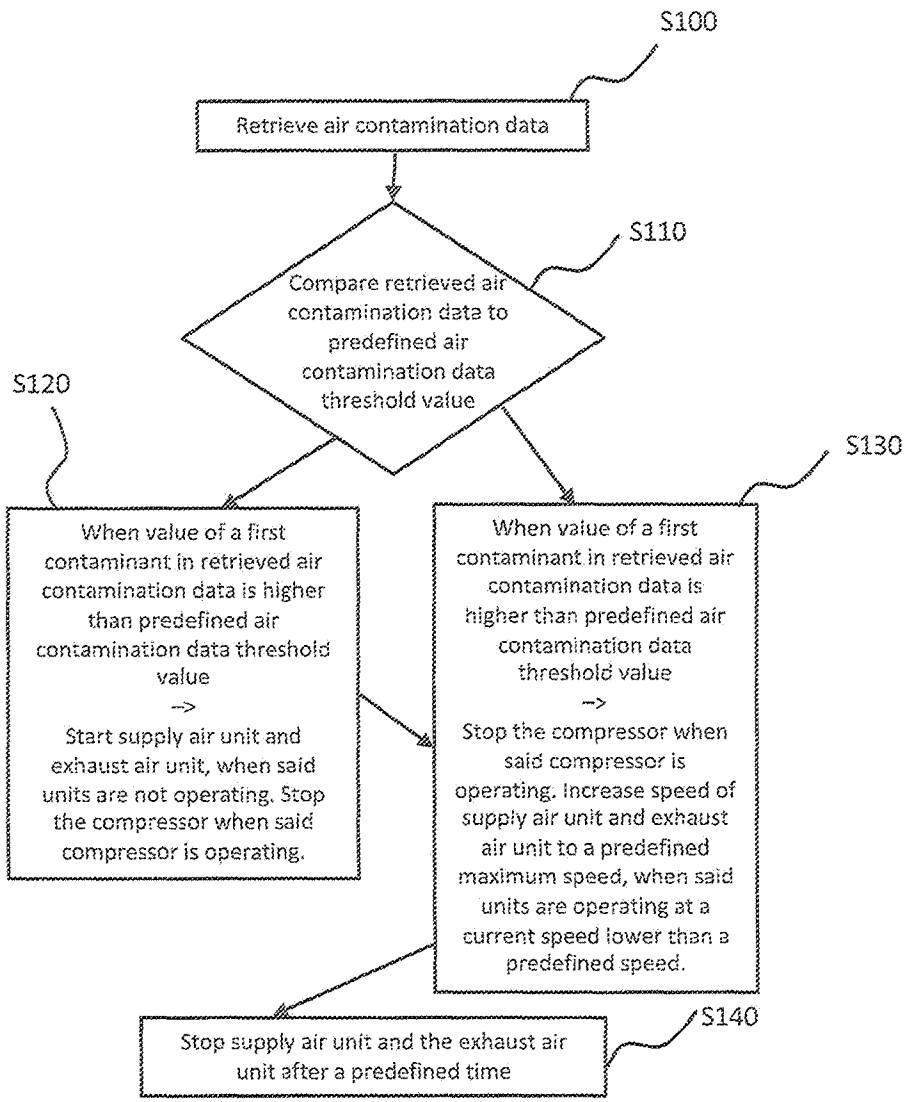
FIG. 7 shows a flow chart of a method according to an embodiment of the invention.
Figure 8:
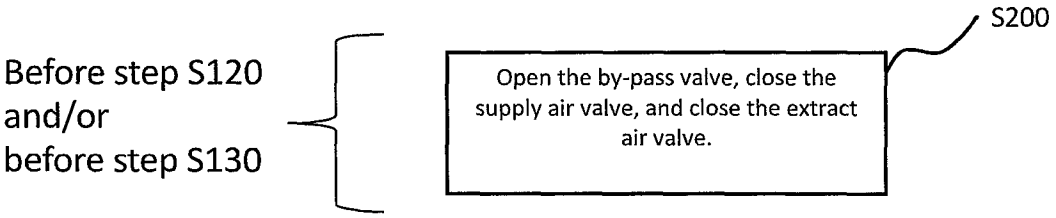
FIG. 8 shows a flow chart of a method according to an embodiment of the invention.
Figure 9:
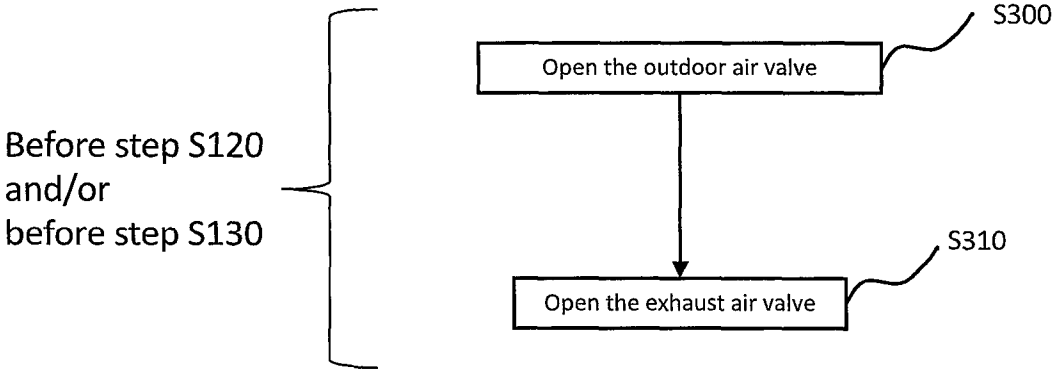
FIG. 9 shows a flow chart of a method according to an embodiment of the invention.

FIGS. 6*a*, 6*b* and 6*c* show a safety system 1 for evacuation of contaminated air and prevention of ignition in an air handling system 2, according to an embodiment of the invention. The air handling system 2 is further made up of a compressor enclosure 22. The safety system 1 is further made up a compressor enclosure contamination sensor 23 arranged in the compressor enclosure 22 for collection of air contamination data 9, and a compressor enclosure duct unit 24 connected to the compressor enclosure 22 for evacuation of contaminated air from the compressor enclosure 22. A duct inlet 26 of the compressor enclosure duct unit 24 is arranged in a bottom part 27 of the compressor enclosure 22. An air supply inlet 28 for supply of air may be arranged in a top part 29, in a middle part 30 or in the bottom part 27 of the compressor enclosure 22.

In FIG. 6*c* the compressor enclosure duct unit 24 is further made up of a compressor enclosure extract air unit 25. Contaminated air from the compressor enclosure is directly evacuated, for instance to the ambient In a step S100 air contamination data 9 is continuously retrieved by means of the air contamination sensor 8. In a step S110 the retrieved air contamination data 9 is compared to the predefined air contamination data threshold value 11 by means of the control unit 10. In a step S120, when a value v1 of a first contaminant in the retrieved air contamination data 9 is higher than the predefined air contamination data threshold value 11, the control unit 10 sends instructions to start the supply air unit 3 and the exhaust air unit 5, when said units 3, 5 are not operating, and to stop the compressor, when said compressor is operating. In a step S130, when a value v1 of a first contaminant in the retrieved air contamination data 9 is higher than the predefined air contamination data threshold value 11, the control unit 10 sends instructions to increase the speed of the supply air unit 3 and the exhaust air unit 5 to a predefined maximum speed 31, when said units 3, 5 are operating at a current speed 32 lower than a predefined speed 33, and to stop the compressor, when said compressor is operating. In a step S140, when a value v2 of the first contaminant in the retrieved air contamination data 9 is lower than the predefined air contamination data threshold value 11, the control unit 10 sends instructions to stop the supply air unit 3 and the exhaust air unit 5 after a predefined time 34.

In a step S200 before step S120 and/or before step S130 the by-pass valve 17 is opened, the supply air valve 13 is closed, and the extract air valve 15 is closed.

In a step S300 before step S120 and/or before step S130 the outdoor air valve 18 is opened. In a step S310 before step S120 and/or before step S130 the exhaust air valve 20 is opened.

Figure 10:
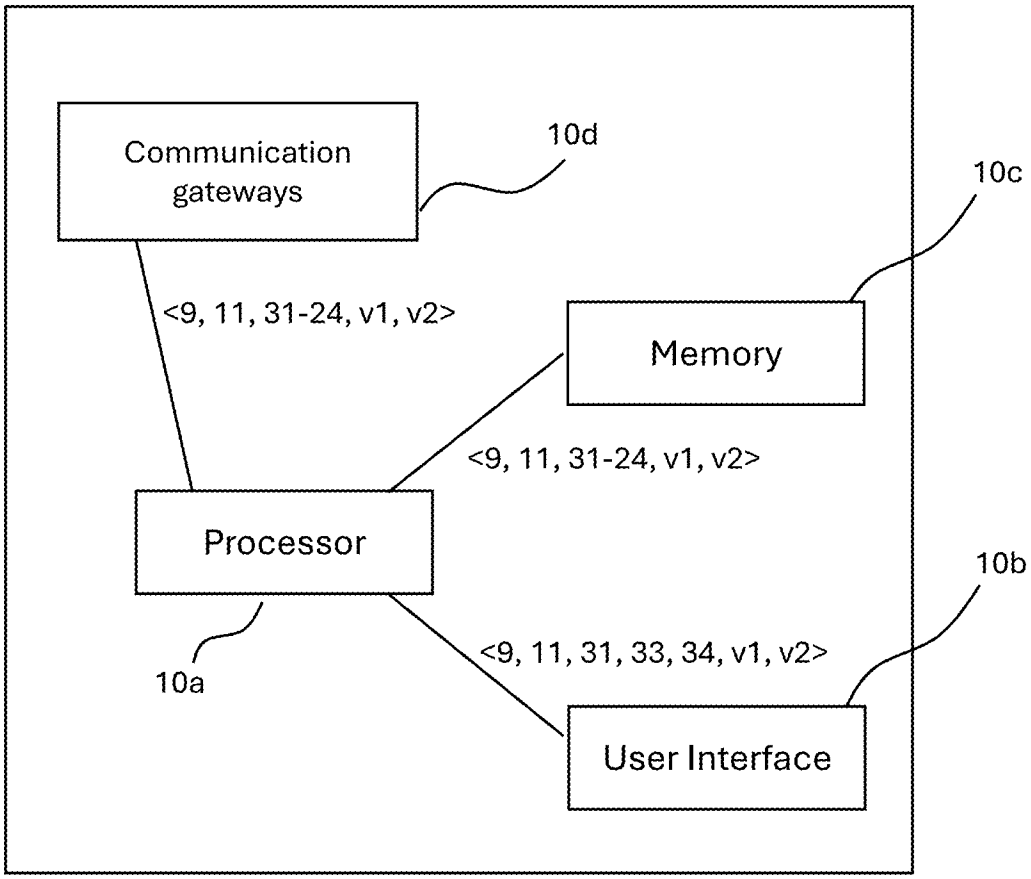
FIG. 10 shows a block diagram of a control system according to an embodiment of the invention.

FIG. 10 shows a block diagram of a control system 10, comprising a processor 10.*a*, a user interface 10.*b*, a memory 10.*c*, and communication gateways 10.*d*. Through the communication gateways the control system can receive and send signals from/to other parts of the system. Through the user interface the control system can communicate with the user, through for instance a viewing screen, keyboard, mouse, printer, loud speaker, microphone or other type of peripheral. The computer program product can be stored in the memory, and be executed in the processor.

The air to be treated passes through the evaporator/condenser coil in the air treatment space. The treated air is to be transferred to the premises where e.g. human beings are to be found. In the air treatment space or in said premises there should be no leaking refrigerant.

LIST OF COMPONENTS

1=safety system
2=air handling system
3=supply air unit
4=supply air duct
5=exhaust air unit
6=exhaust air duct
7=supply air contamination sensor
8=exhaust air contamination sensor
9=air contamination data
10=control unit
10.*a*=processor
10.*b*=user interface
10.*c*=memory
10.*d*=communication gateways
11=predefined air contamination data threshold value
12=power supply
13=supply air valve
14=supply air outlet end
15=extract air valve
16=extract air inlet end
17=by-pass valve
18=outdoor air valve
19=outdoor air inlet end
20=exhaust air valve
21=exhaust air outlet end
22=compressor enclosure
23=compressor enclosure contamination sensor
24=compressor enclosure duct unit
25=compressor enclosure extract air unit
26=duct inlet of the compressor enclosure duct unit
27=bottom part of the compressor enclosure
28=air supply inlet
29=top part of the compressor enclosure

30=middle part of the compressor enclosure
31=predefined maximum speed of the supply air unit and the exhaust air unit
32=current speed of the supply air unit and the exhaust air unit
33=a predefined speed of the supply air unit and the exhaust air unit
34=predefined time
35=room
36=compressor
37=refrigerant
38=evaporator/condenser coil
v1, v2=value of a first contaminant in the retrieved air contamination data
$A_S$=supply air
$A_E$=used extract air

The invention claimed is:

1. A method for controlling a safety system for evacuation of contaminated air and prevention of ignition in an air handling system, wherein the air handling system comprises a compressor for compressing a refrigerant for further being led through an evaporator/condenser coil arranged in the air handling system, a supply air unit arranged in a supply air duct, and an exhaust air unit arranged in an exhaust air duct, wherein the safety system comprises a supply air contamination sensor arranged in the supply air duct, an exhaust air contamination sensor arranged in the exhaust air duct, wherein the supply air contamination sensor and the exhaust air contamination sensor collect air contamination data, wherein the air handling system further comprises a control unit for comparison of collected air contamination data to a predefined air contamination data threshold value, and for controlling the supply air unit, and the exhaust air unit, wherein the air handling system further comprises a power supply for providing power to the supply air unit, the exhaust air unit and the control unit, and wherein a supply air valve, variable between a closed and an open position, arranged in a supply air outlet end of the supply air duct for the supply of supply air (As) to a room, an extract air valve, variable between a closed and an open position, arranged in an extract air inlet end of the exhaust air duct for the extraction of used extract air (AE) from the room into the exhaust air duct, and a by-pass valve, variable between a closed and an open position, arranged to connect the supply air duct and the exhaust air duct for the fluid connection of supply air (As) in the event that the supply air valve and the extract air valve are closed, wherein the supply air valve, the extract air valve and the by-pass valve are controlled by the control unit, wherein the method comprises the steps of:

a) continuously retrieving air contamination data by means of the air contamination sensors,
b) comparing the retrieved air contamination data to the predefined air contamination data threshold value by means of the control unit, when a value (v1) of a first contaminant in the retrieved air contamination data is higher than the predefined air contamination data threshold value, the control unit sends instructions to:
c) start the supply air unit and the exhaust air unit, when said units are not operating,
d) opening the by-pass valve, closing the supply air valve, and closing the extract air valve, wherein step d occurs prior to step e;
e) stop the compressor, when said compressor is operating,
f) increase the speed of the supply air unit and the exhaust air unit to a predefined maximum speed, when said units are operating at a current speed lower than a predefined speed, and when a value (v2) of the first contaminant in the retrieved air contamination data is lower than the predefined air contamination data threshold value, the control unit sends instructions to:

g) stop the supply air unit and the exhaust air unit after a predefined time.

2. Method according to claim 1, wherein the safety system further comprises an outdoor air valve, variable between a closed and an open position, arranged in an outdoor air inlet end of the supply air duct for the supply of supply air (As) into the supply air duct, an exhaust air valve, variable between a closed and an open position, arranged in an exhaust air outlet end of the exhaust air duct for the exhaust of used extract air (AE) from the exhaust air duct to the ambient, and wherein the outdoor air valve and the exhaust air valve are controlled by the control unit, wherein the method further comprises, before step c, the steps of:

a) opening the outdoor air valve, and,
b) opening the exhaust air valve.

* * * * *